US006470616B1

(12) United States Patent
Clay

(10) Patent No.: US 6,470,616 B1
(45) Date of Patent: Oct. 29, 2002

(54) COMBINATION BARREL ADJUSTMENT AND MAGAZINE CUTOFF FOR A TAKEDOWN FIREARM

(76) Inventor: David Richard Clay, 107 Colony Dr., Arlington, TX (US) 76002

( * ) Notice: Subject to any disclaimer, the term of this patent is extended or adjusted under 35 U.S.C. 154(b) by 0 days.

(21) Appl. No.: 09/775,090

(22) Filed: Jan. 31, 2001

(51) Int. Cl.[7] ..... F41A 21/00
(52) U.S. Cl. ..... 42/75.02; 42/75.01
(58) Field of Search ..... 42/75.02, 75.01

(56) References Cited

U.S. PATENT DOCUMENTS

| | | | | | |
|---|---|---|---|---|---|
| 529,455 | A | * | 11/1894 | Marlin | 42/75.02 |
| 618,033 | A | * | 1/1899 | Hemming | 42/49.01 |
| 855,181 | A | * | 5/1907 | Johnson | 42/75.02 |
| 1,065,341 | A | * | 6/1913 | Browning | 42/1.07 |
| 1,163,156 | A | * | 12/1915 | Johnson | 42/75.02 |
| 1,373,888 | A | * | 4/1921 | Johnson | 42/75.02 |
| 4,519,156 | A | * | 5/1985 | Shaw | 42/51 |
| 5,020,260 | A | | 6/1991 | Houghton | 42/75.02 |
| 5,412,895 | A | * | 5/1995 | Krieger | 42/75.02 |
| 5,540,008 | A | * | 7/1996 | Kirnstatter | 42/75.02 |
| 5,907,919 | A | * | 6/1999 | Keeney | 42/75.02 |
| 6,250,198 | B1 | * | 6/2001 | Vendetti et al. | 42/75.02 |

* cited by examiner

*Primary Examiner*—Charles T. Jordan
*Assistant Examiner*—John W. Zerr
(74) *Attorney, Agent, or Firm*—Bracewell & Patterson, L.L.P.

(57) ABSTRACT

A flex-plate adapter for a takedown firearm has front and rear sections. The rear section includes adjustment screws to change the gap between the front and rear sections. Guide pins are included for assuring proper alignment between the front and rear sections. The adjustable gap between the front and rear sections of the flex-plate adapter provides compensation for thread wear. A magazine cutoff provides a manual cutoff for retaining ammunition in the magazine whether the rifle is assembled or disassembled. A cutoff lock prevents the accidental movement of the magazine cutoff.

14 Claims, 2 Drawing Sheets

COMBINATION BARREL ADJUSTMENT AND MAGAZINE CUTOFF FOR A TAKEDOWN FIREARM

BACKGROUND OF THE INVENTION

1. Field of the Invention

The present invention generally relates to firearms and particularly relates to takedown firearms.

2. Description of the Prior Art

Takedown lever-action rifles are a type of lever-action rifle that is particularly popular. The term "takedown rifle" describes a rifle in which the barrel and fore-end are readily connected with and detached from the buttstock and receiver frame so as to permit the rifle to be more easily packed and compactly transported.

During World War II, the Japanese developed a takedown rifle for issue to airborne units. A standard bolt-action rifle was modified to accommodate a special barrel with interrupted threads at its chamber end that mated with threads on a sleeve provided at the front end of the receiver. This rifle proved to be unsuccessful. Thereafter, another version was developed which featured a barrel locked in place by means of a tapered wedge but its accuracy at best was mediocre.

Rifles utilizing a takedown feature are shown in U.S. Pat. Nos. 529,455; 534,691; 605,111; 605,734; 616,719; 755,660; 855,181; 1,065,341 and 1,370,836. In spite of numerous developments in the art of takedown rifles, virtually all such rifles suffer from the inability to "hold zero," or repeat the point-of-aim after the barrel has been repeatedly removed and reinstalled. Lever-action rifles, in particular, suffer because they are used for hunting and are frequently disassembled. This disassembly/assembly operation puts stress on the threads in the barrels and receivers, causing the barreled fore-end and front sight to be misaligned with the receiver and rear sight when completely assembled.

Deviation is not acceptable for long range precision shooting such as may be required for target use or sniper use by the military and law enforcement organizations. In order to obtain the degree of accuracy considered acceptable for sniper or target shooting, all components of any rifle, and particularly a takedown rifle, must fit together in an extremely tight manner with very close tolerances. Without the means to compensate for wear, particularly wear of the threads in mating parts, any rifle that is repeatedly disassembled and reassembled will lose its accuracy, resulting in a change in the point of impact of the bullet.

The ammunition magazine for lever-action rifles is typically located beneath, and attached to, the barrel. Generally, ammunition in the magazine of a takedown rifle is retained in the magazine only while the rifle is completely assembled. There is no provision for retaining ammunition therein while disassembled. Thus, when the rifle is reassembled, ammunition must be loaded into the magazine through the rifle's receiver.

Consequently, there is a need to provide a takedown lever-action firearm that can be repeatedly disassembled and reassembled with provision for maintaining its accuracy. There is also a need for retaining ammunition in the magazine while the weapon is disassembled to provide ready and immediate access when reassembled.

SUMMARY OF THE INVENTION

It is therefore one object of the present invention to provide a method and apparatus that will allow for easy assembly and disassembly of the barrel to the receiver and effectively compensate for wear in the threaded connection that mates the barrel to the rifle.

It is another object of the present invention to provide an apparatus for retaining ammunition in the magazine of the rifle when disassembled.

A flex-plate adapter for a takedown firearm is provided which has front and rear sections. The rear section includes adjustment screws to change the gap between the front and rear sections. Guide pins are included for assuring proper alignment between the front and rear sections. The adjustable gap between the front and rear sections of the flex-plate adapter provides compensation for thread wear. A magazine cutoff provides a manual cutoff for retaining ammunition in the magazine whether the rifle is assembled or disassembled. A cutoff lock prevents the accidental movement of the magazine cutoff.

BRIEF DESCRIPTION OF THE DRAWINGS

The novel features believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
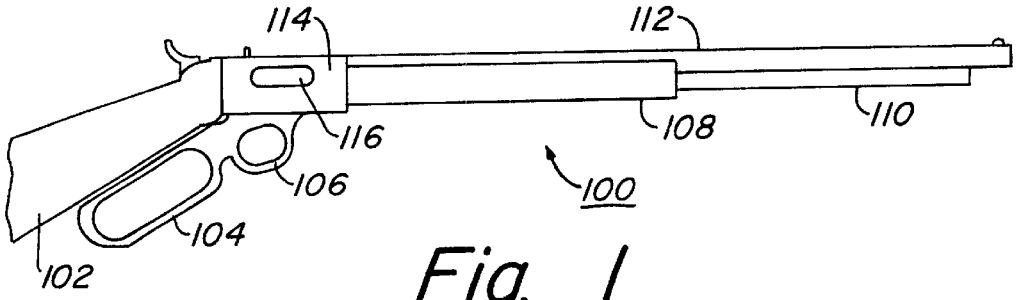
Fig. 1 (PRIOR ART)
FIG. 1 is a side elevational view of a prior art takedown firearm.

With reference now to the figures, and in particular with reference to FIG. 1, a takedown firearm 100 is illustrated. Firearm 100 is, in this case, a lever-action rifle. Buttstock 102 is generally constructed of non-metal material and is placed against a shooter's shoulder for shooting. Lever 104 is part of a mechanism which cocks the hammer of the rifle, ejects a spent ammunition case, and chambers a live round of ammunition for firing. Trigger guard 106 prevents an accidental trigger pull. Fore-end 108 is used for holding the rifle. Magazine 110 is removably attached to barrel 112 and is used for storing a horizontal column of ammunition which is spring-biased toward the receiver. The live round is inserted into the firing chamber utilizing lever 104 mechanism prior to firing. The spent cartridge is ejected from ejection slot 116 when lever 104 is actuated to load a live ammunition round into receiver 114.

Figure 2:
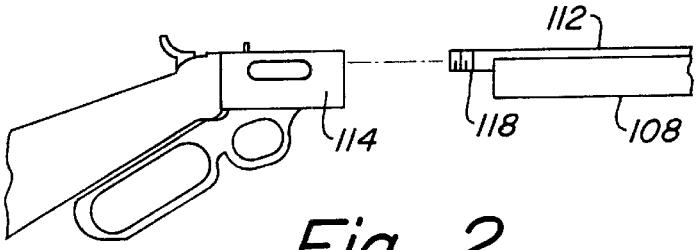
Fig. 2 (PRIOR ART)
FIG. 2 is a an exploded view of the prior art takedown rifle of FIG. 1 illustrating the means for connecting the barrel and the receiver.

The lever-action rifle illustrated is a takedown rifle showing the connecting mechanism between the barrel and the receiver in FIG. 2. Generally, a takedown rifle utilizes a threaded extension of the barrel to positively connect to the receiver. Barrel connector 118, a threaded portion of barrel 112, is used to connect to receiver 114. This feature of easy assembly, by threading barrel 112 to receiver 114, allows for easy carrying and storage of rifle 100. However, because of the frequency of use of the takedown feature, the threads become worn over time and the alignment of barrel 112 and receiver 114 changes.

Figure 3:
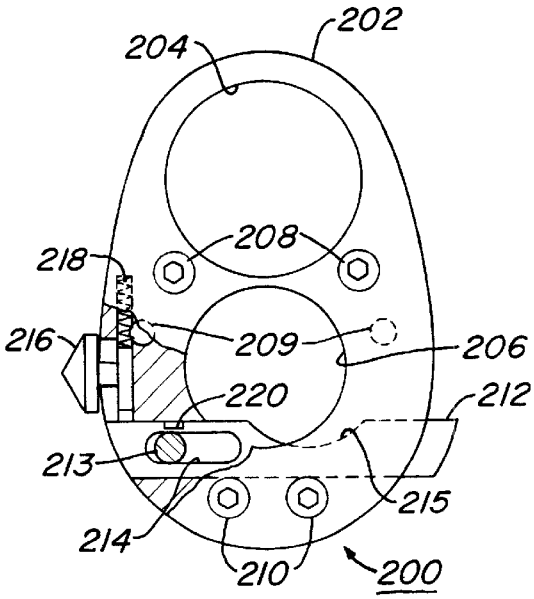
FIG. 3 is an enlarged rear view of a flex-plate adapter for adjusting alignment of a takedown firearm barrel and retaining ammunition in the magazine in accordance with a preferred embodiment of the present invention.
Figure 4:
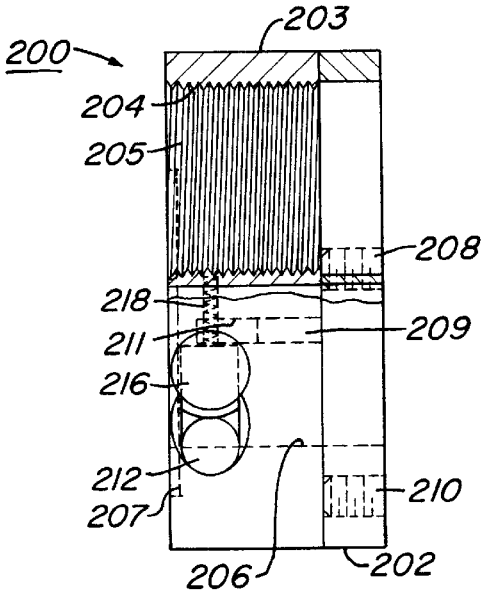
FIG. 4 is a side elevational view of the adapter of FIG. 3.

Referring to FIGS. 3 and 4, a detailed view of a flex-plate adapter for adjusting alignment of a takedown firearm barrel and retaining ammunition in the magazine in accordance with a preferred embodiment of the present invention is illustrated in a rear view (FIG. 3) and a side view (FIG. 4). Flex-plate adapter 200 comprises two sections: adjustment section 202 and receiver section 203. Barrel opening 204 and magazine opening 206 are cylindrical and extend through both sections 202, 203. The portion of opening 204 in section 203 is shown as having threads 205, though section 203 may be attached to barrel connector 118 by other means such as, for example, soldering. The front surface of section 203 has a recess 207 shaped for receiving fore-end 108. Though not shown in the figures, magazine opening 206 may have a relief cutout in the forward area when used in larger caliber rifles, the cutout providing sufficient clearance to allow larger cartridges to be loaded into magazine 110.

Guide pins 209 protrude from the front surface of adjustment section 202. When assembled, guide pins 209 are inserted into receiving sockets 211 in receiver section 203. Allen screws 208, 210 connect the sections and adjust the distance from the front surface of section 202 to the rear surface of section 203. As allen screws 208, 210 are turned, the longitudinal length of adapter 200 changes. Allen screws 208, 210 are adjusted until the length of adapter 200 is such that, when assembled, barrel 112 is tightly fitted to receiver 114. Screws 208, 210 also may be adjusted individually to alter the planar orientation of sections 202, 203 to each other for adjusting the point-of-impact of a bullet fired from barrel 112. Only slight changes in the planar orientation are required to adjust the vertical or horizontal position of the forward end of barrel 112 (FIG. 1) relative to receiver 114 (FIG. 1). Guide pins 209 deflect a small amount if the planar orientation is other than parallel.

Magazine cutoff 212 is used for retaining ammunition within magazine 110 by partially blocking opening 206. Cutoff 212 is a cylindrical pin extending transversely through section 203 and is shown fully extended in the closed position which prevents ammunition from exiting magazine 110 (FIG. 1). Screw 213 engages a translating slot 214 in cutoff 212 for retaining and limiting the travel of cutoff 212 within section 203. Screw 213 preferably has a spring-biased plunger for engaging detents (not shown) in slot 214 as cutoff 212 is moved into the open and closed positions.

When cutoff 212 is moved to the open position, a cutout 215 aligns with the bottom of opening 206, permitting ammunition stored in magazine 110 to feed into receiver 114. When disassembling the rifle, cutoff 212 is pushed to the closed position to move cutout 215 out of alignment with opening 206, preventing ammunition from exiting magazine 110. Cutoff lock 216 is located above cutoff 212 in section 203 and prevents accidental cutoff of ammunition. Lock 216 comprises a vertical plate within section 203 and an attached head external to section 203. Lock 216 is spring-biased in a downward direction by spring 218, and a lower portion of the vertical plate of lock 216 engages notch 220 in cutoff 212 when cutoff 212 is moved to the open position. To move cutoff 212 to the closed position, lock 216 is pulled upward as cutoff 212 is simultaneously moved to the closed position. Though shown in the figures as a sliding type, cutoff 212 may also be rotary.

Figure 5:
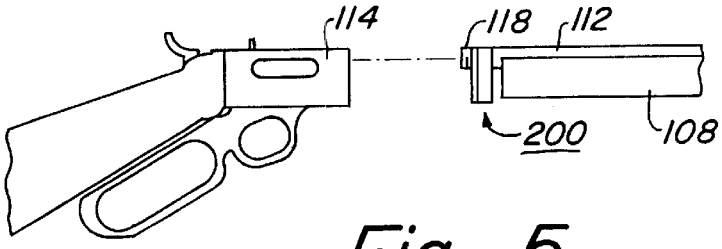
FIG. 5 is a an exploded side elevational view of a takedown firearm having an adapter in accordance with FIG. 3.
Figure 6:
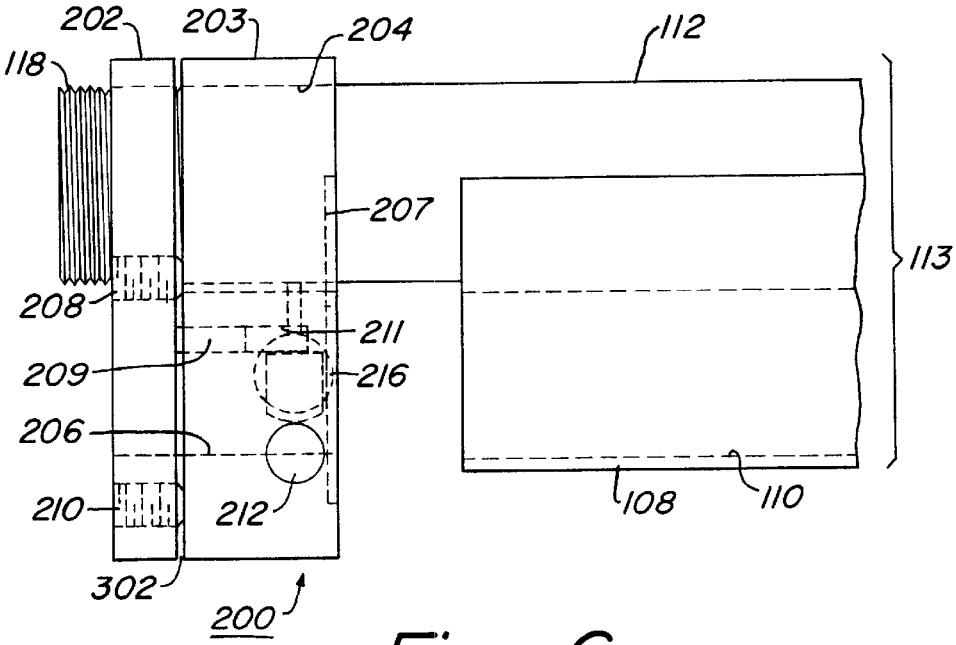
FIG. 6 is a view of the flex-plate adapter of FIG. 3 partially assembled with the firearm of FIG. 5.

Referring now to FIGS. 5 and 6, flex-plate adapter 200 is shown partially assembled to the fore-end portion 113 of a takedown rifle. Barrel connector 118, a threaded portion of barrel 112, is shown inserted into opening 204 of adapter 200. Threads 205 of receiver section 203 engage threads on barrel connector 118. Allen screws 208, 210 are shown in an extended position, illustrating the adjustment feature of adapter 200. Gap 302 is a result of the adjustment of alien screws 208, 210. Guide pins 209 are inserted into sockets 211 for maintaining the alignment of adjustment portion 202 with receiver portion 203 of flex plate 200.

Flex-plate adapter 200 is properly fitted and adjusted prior to affixing section 203 to the barrel/fore-end portion 113 of the takedown rifle. Receiver section 203 of flex-plate adapter 200 abuts fore-end 108 and receives barrel 112. To install the combination of flex-plate adapter 200 and fore-end 113, barrel connector 118 is threaded into receiver 114 until adjustment section 202 abuts receiver 114 and the connection is completely tightened. Necessary adjustments in gap 302 are made by removing fore-end 113 and adapter 200 and adjusting allen screws 208, 210 until proper alignment of fore-end 113 to receiver 114 is achieved when the rifle is reassembled. Compensation for any change in travel of barrel connector 118 is made by adjusting gap 302 of flex-plate adapter 200, thus increasing or decreasing the travel distance of the threads of barrel connector 118 into receiver 114. To allow ammunition to feed in to receiver 114, cutoff 212 is moved from the closed position to the open position until lock 216 engages notch 220. To prevent ammunition from feeding, cutoff lock 216 is moved upward to disengage lock 216 from notch 220, and cutoff 212 is moved to the closed position.

The adapter of the present invention has the advantage of providing a means of compensating for thread wear in the connection between the fore-end and receiver of a takedown firearm. By having multiple screws connecting the front and rear sections of the adapter, an additional advantage is that the point-of-impact can be adjusted vertically and horizontally. Also, the magazine cutoff allows for ammunition to be retained in the magazine when the rifle is disassembled. The cutoff lock prevents accidental cutoff of the magazine.

While the invention has been particularly shown and described with reference to a preferred embodiment, it will be understood by those skilled in the art that various changes in form and detail may be made therein without departing from the spirit and scope of the invention.

I claim:

1. An apparatus for barrel adjustment in a takedown firearm, the apparatus comprising:

a front section and a rear section, a distance between a forward surface of the rear section and rearward surface of the front section being adjustable, a forward surface of the front section being adapted to abut a rearward surface of a fore-end of a firearm, a rearward surface of the rear section being adapted to abut a forward surface of a receiver of the firearm;

an upper opening extending through both sections and adapted to receive a rear portion of a barrel;

a lower opening extending through both sections and adapted to receive a rear portion of a magazine; and at least one pin for maintaining alignment of one of the sections to the other of the sections, the pin extending from one of the sections and being received by a socket in the other of the sections.

2. The apparatus of claim 1, further comprising:

a magazine cutoff extending through one of the sections transverse to the lower opening and adapted to selectively prevent ammunition stored in the magazine from passing through the lower opening.

3. The apparatus of claim 2, wherein:

the magazine cutoff comprises a pin that is selectively movable between a first position and a second position, the first position being adapted to prevent ammunition carried in the magazine from passing through the lower opening, the second position being adapted to allow ammunition to move through the lower opening.

4. The apparatus of claim 3, further comprising:

a magazine cutoff lock mounted to one of the sections for selectively preventing movement of the magazine cutoff between the first and second positions.

5. An apparatus for barrel adjustment in a takedown firearm, the apparatus comprising:

a front section and a rear section, a distance between a forward surface of the rear section and rearward surface of the front section being adjustable, a forward surface of the front section being adapted to abut a rearward surface of a fore-end of a firearm, a rearward surface of the rear section being adapted to abut a forward surface of a receiver of the firearm;

an upper opening extending through both sections and adapted to receive a rear portion of a barrel; and at least one pin for maintaining alignment of one of the sections to the other of the sections, the pin extending from one of the sections and being received by a socket in the other of the sections; and wherein the distance is adjusted by at least one screw which connects the sections to one another.

6. The apparatus of claim 5, wherein:

the at least one screw comprises at least two screws; and the screws are individually adjustable for changing a planar orientation of the sections to each other.

7. In a takedown firearm having a fore-end which carries a barrel and a magazine and is detachable from a receiver, the improvement comprising:

a front section and a rear section, a distance between a forward surface of the rear section and rearward surface of the front section being adjustable, a forward surface of the front section abutting a rearward surface of the fore-end of the firearm, a rearward surface of the rear section abutting a forward surface of the receiver of the firearm;

an upper opening extending through both sections and receiving a rear portion of the barrel;

a lower opening extending through both sections and receiving a rear portion of the magazine;

at least one pin for maintaining alignment of one section to the other, the pin extending from one of the sections and being received by a socket in the other of the sections;

at least one screw which connects the sections to one another; and a magazine cutoff mounted to one of the sections that is selectively movable to at least partially obstruct the lower opening and to selectively prevent ammunition stored in the magazine from passing through the lower opening.

8. The apparatus of claim 7, further comprising:

threads located in the upper opening of the front section for securing to threads located on the rear portion of the barrel.

9. The apparatus of claim 7, wherein:

the at least one screw comprises at least two screws; and the screws are individually adjustable for changing a planar orientation of the sections to each other.

10. The apparatus of claim 7, wherein:

the magazine cutoff comprises a pin extending transversely through one of the sections, the pin being selectively movable between a first position, in which ammunition carried in the magazine is prevented from passing through the lower opening, and a second position, in which ammunition is allowed to move through the lower opening.

11. The apparatus of claim 10, further comprising:

a magazine cutoff lock for selectively preventing movement of the magazine cutoff between the first and second positions.

12. A method of assembling a takedown firearm having a barrel, a fore-end, and a magazine, the method comprising:

(a) providing an adapter having front and rear sections;

(b) inserting the barrel into an upper opening extending through both sections;

(c) inserting the magazine into a lower opening extending through both sections;

(d) adjusting screws connecting the sections to one another to select a distance between the sections and to select a planar orientation of the sections relative to each other; and (e) securing the barrel to the receiver, abutting a rearward surface of the fore-end of the firearm with the front section, and abutting a forward surface of a receiver of the firearm with the rear section.

13. The method of claim 12, wherein step (b) further comprises:

securing threads located in the upper opening of the front section to threads on the barrel.

14. The method of claim 12, further comprising:

selectively preventing ammunition carried in the magazine from exiting the magazine by at least partially obstructing the lower opening of one of the sections.

* * * * *